US008870609B2

(12) United States Patent
Eberts et al.

(10) Patent No.: US 8,870,609 B2
(45) Date of Patent: Oct. 28, 2014

(54) ATTACHMENT APPARATUS USABLE IN CIRCUIT INTERRUPTER ENVIRONMENT AND STRUCTURED TO CONNECT A RING TERMINAL TO THE CIRCUIT INTERRUPTER

(71) Applicant: Eaton Corporation, Cleveland, OH (US)

(72) Inventors: William George Eberts, Moon Township, PA (US); Kenneth D. Kolberg, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 161 days.

(21) Appl. No.: 13/655,932

(22) Filed: Oct. 19, 2012

(65) Prior Publication Data

US 2014/0110230 A1 Apr. 24, 2014

(51) Int. Cl.
*H01R 4/36* (2006.01)

(52) U.S. Cl.
USPC ..... 439/814

(58) Field of Classification Search
USPC ..... 439/814, 810–813; 337/113; 335/202
See application file for complete search history.

(56) References Cited

U.S. PATENT DOCUMENTS

| | | | | |
|---|---|---|---|---|
| 4,603,376 | A | 7/1986 | Maier | |
| 6,280,264 | B1 | 8/2001 | Whipple et al. | |
| 6,529,112 | B1 * | 3/2003 | Leone | 337/113 |
| 6,930,577 | B2 * | 8/2005 | Subramanian et al. | 335/202 |
| 2005/0057333 | A1 | 3/2005 | Subramanian et al. | |

OTHER PUBLICATIONS

European Patent Office, "International Search Report and Written Opinion", Nov. 27, 2013, 8 pp.

* cited by examiner

*Primary Examiner* — Xuong Chung Trans
(74) *Attorney, Agent, or Firm* — Eckert Seamans Cherin & Mellott, LLC; Brij K. Agarwal

(57) ABSTRACT

An attachment apparatus is usable as a line terminal or load terminal of a circuit interrupter to enable a conductive element that includes a ring terminal to be electrically connected with a conductor of a circuit interrupter. The attachment apparatus employs a conventional lug which serves as a connector. The lug includes a threaded engagement element. The attachment apparatus further includes a connection element having a threaded receptacle that is structured to receive a shank of a threaded fastener. The shank is received through a hole formed in a ring terminal and is further threadably receivable in the receptacle of the connection apparatus to enable the ring terminal and a wire connected therewith to be reliably electrically connected with a line conductor or a load conductor of the circuit interrupter. The threaded shank can be unthreaded from the connection element to permit removal of the ring terminal and associated wire.

12 Claims, 3 Drawing Sheets

ATTACHMENT APPARATUS USABLE IN CIRCUIT INTERRUPTER ENVIRONMENT AND STRUCTURED TO CONNECT A RING TERMINAL TO THE CIRCUIT INTERRUPTER

BACKGROUND OF THE INVENTION

1. Field

The disclosed and claimed concept relates generally to circuit interrupters and, more particularly, to an attachment apparatus that is configured to enable a conductive element to be electrically connected with a circuit interrupter.

2. Related Art

Numerous types of circuit interrupters are usable in numerous applications. Circuit interrupters are typically employed to open at least a portion of a protected circuit during certain predefined overcurrent conditions, under-voltage conditions, and other conditions. As is generally understood, a circuit interrupter such as a circuit breaker may include a line conductor that is connected with a source of electrical power, a load conductor that is connected with a device that consumes electrical power, and a set of separable electrical contacts that are separable to open a portion of a protected circuit. While such circuit breakers have been generally effective for their intended purposes, they have not been without limitation.

One shortcoming that exists with the use of known circuit breakers and associated equipment is in the area of the terminals that are used for connecting sources of electrical power to the line conductors of circuit breakers, as well as the terminals that are used for connecting electrical loads to the load conductors of circuit breakers. The various types of wiring and connectors that can exist, as well as the variety of electrical appliances and other devices that use electricity, have caused a level of difficulty since the line terminals and load terminals of conventional circuit breakers typically have not been configured to enable an unlimited variety of conductive elements to be connected with the conductors of the circuit breaker. In certain applications, compressive lugs have been employed as line or load terminals to compressively connect a wire with a conductor of a circuit breaker and to serve as the line terminal or load terminal as the case may be. By way of example, a conventional 3/0 aluminum lug has an opening that is structured to receive both a wire and a circuit breaker's load conductor therein, and the lug further includes a threaded engagement element that compressively engages together the wire and the load conductor to retain them electrically connected. While a conventional 3/0 lug can easily be used as a load terminal to connect a 3/0 wire to a load conductor of the circuit breaker, the same lug typically is not necessarily configured to effectively connect to the load conductor a wire having, for instance, a ring terminal. It thus would be desirable to provide an improved circuit breaker and an improved attachment apparatus that can serve as a line terminal or a load terminal and that meet these and other shortcomings known in the relevant art.

SUMMARY OF THE INVENTION

In view of the foregoing, an improved attachment apparatus is usable as a line terminal or a load terminal of a circuit interrupter and is configured to enable a conductive element, such as one that includes a ring terminal, to be electrically connected with a conductor of a circuit interrupter. The improved attachment apparatus employs a conventional lug such as a 3/0 lug which is modified and which serves as a connector. The lug includes a threaded engagement element which, in its conventional use, compressively engages electrical conductors. The attachment apparatus further includes a connection element having a threaded receptacle that is structured to receive a threaded shank of a threaded fastener. The connection element is compressively engaged with and electrically connected with a line or load conductor of a circuit interrupter by employing the threaded engagement element of the lug to provide such compression. The shank of the threaded fastener is received through a hole formed in a ring terminal and is further threadably receivable in the receptacle of the connection apparatus to enable the ring terminal and a wire connected therewith to be reliably electrically connected with the line or load conductor of the circuit interrupter. The threaded shank can be unthreaded from the connection element to permit removal of the ring terminal and associated wire.

Accordingly, an aspect of the disclosed and claimed concept is to provide an improved attachment apparatus that is configured to serve as a terminal to enable a conductive element to be electrically connected with a conductor of the circuit interrupter.

Another aspect of the disclosed and claimed concept is to provide an improved circuit breaker that employs such an attachment apparatus as a terminal such as a line terminal or a load terminal or both.

Accordingly, an aspect of the disclosed and claimed concept is to provide an improved attachment apparatus that is structured to enable a conductive element to be electrically connected with a conductor of a circuit interrupter. The attachment apparatus can be generally stated as including a connection apparatus and an electrically conductive threaded fastener. The connection apparatus can be generally stated as including an electrically conductive connection element having a threaded receptacle. The electrically conductive threaded fastener is structured to be threadably cooperable with the receptacle. The fastener has a head and a shank, with the shank being structured to be received through a hole formed in the conductor and to be received in the receptacle. The head and the connection element are structured to retain at least a portion of the conductor situated therebetween and electrically connected therewith.

BRIEF DESCRIPTION OF THE DRAWINGS

A further understanding of the disclosed and claimed concept can be gained from the following Description of the Preferred Embodiments when read in conjunction with the accompanying drawings in which:

Similar numerals refer to similar parts throughout the specification.

DESCRIPTION OF THE PREFERRED EMBODIMENTS

Figure 5:
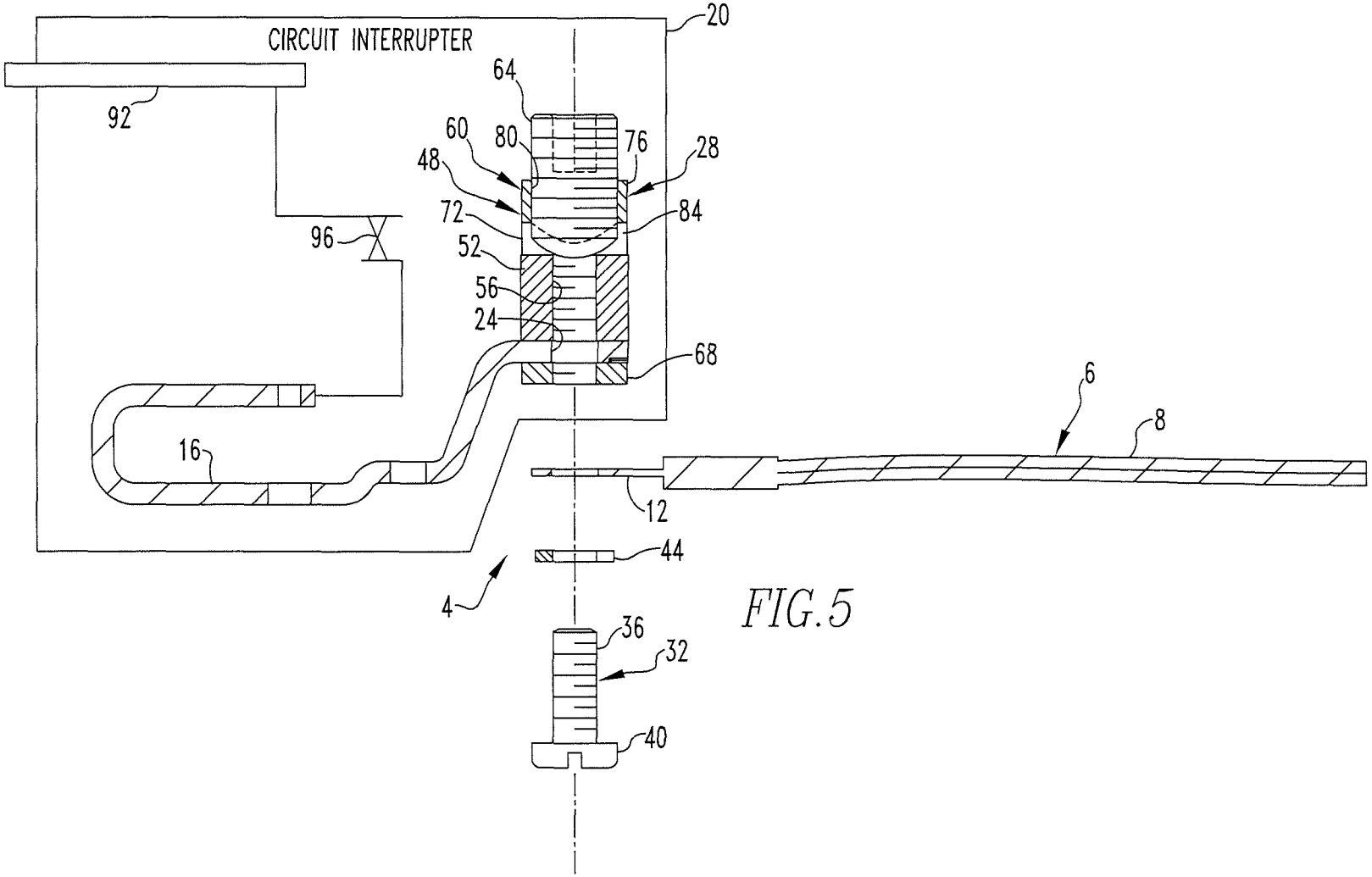
FIG. 5 is a partially disassembled view of the attachment apparatus serving as a load terminal of a schematically-depicted circuit interrupter.

An improved attachment apparatus 4 is depicted in FIGS. 1-5. The attachment apparatus 4 is usable with a conductive element 6 which, in the depicted exemplary embodiment, includes an electric wire 8 that is electrically connected with a ring terminal 12. The improved attachment apparatus 4 advantageously serves as a terminal which enables the conductive element 6 with its ring terminal 12 to be electrically connected with a conductor 16 which, in the depicted exemplary embodiment, is a load conductor of a circuit interrupter 20 (FIG. 5). The load conductor 16 is a conventional conductor such as is used in a conventional circuit interrupter, except that it has been modified to have a hole 24 (FIGS. 4 and 5) formed in its end, such as by drilling of the conductor.

Much of the discussion herein regarding the attachment apparatus 4 is with respect to its use with the load conductor 16 of the circuit interrupter 20. That is, the attachment apparatus 4 is frequently described herein as being connected with the load conductor 16 and as becoming the load terminal of the circuit interrupter 20. It is expressly noted, however, that the attachment apparatus 4 described herein can additionally or alternatively be used in conjunction with a line terminal of the circuit interrupter 20, by which the attachment apparatus 4 becomes the line terminal of the circuit interrupter 20. For the sake of simplicity, much of the discussion herein is with respect to the load conductor, but this is intended to be exemplary only and without limitation on the teachings herein.

Figure 1:
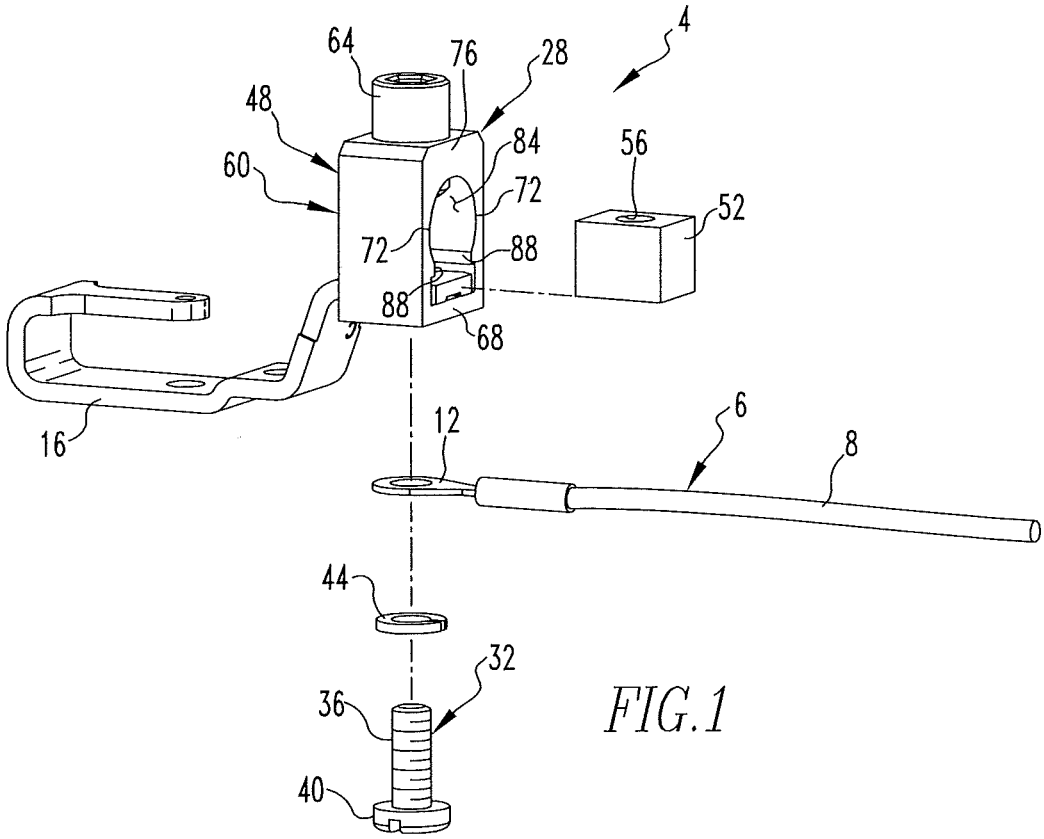
FIG. 1 is an exploded perspective view of an attachment apparatus in accordance with the disclosed and claimed concept that is depicted in conjunction with a conductor of a circuit interrupter and further in conjunction with a conductive element having a ring terminal.
Figure 2:
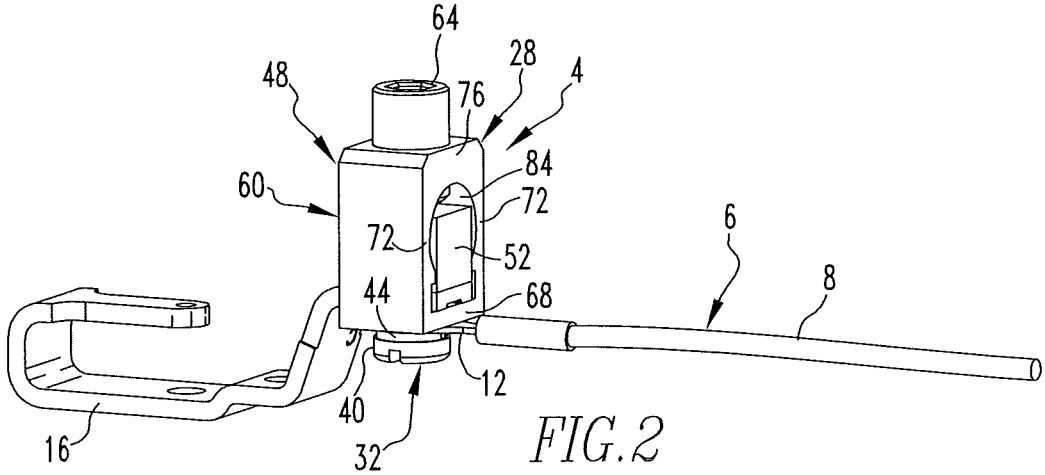
FIG. 2 is a view similar to FIG. 1, except depicting the attachment apparatus in an assembled condition electrically connecting together the conductor and the conductive element.
Figure 3:
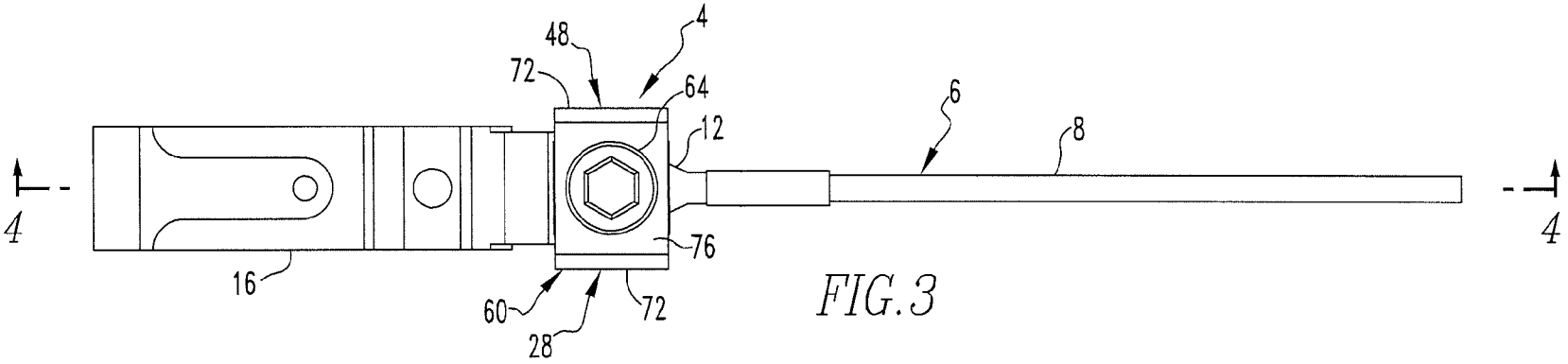
FIG. 3 is a plan view of the attachment apparatus, conductor, and conductive element of FIG. 2.
Figure 4:
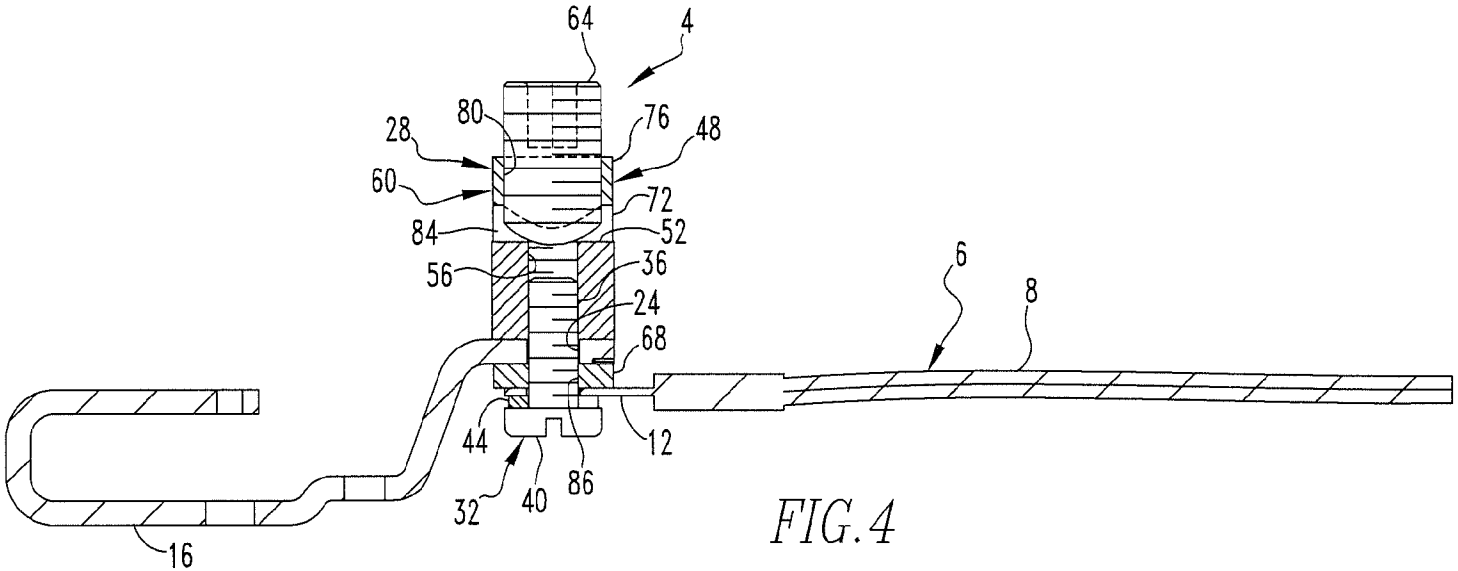
FIG. 4 is a sectional view as taken along line 4-4 of FIG. 3.

As can be seen in FIGS. 1 and 2, the attachment apparatus 4 can be said to include a connection apparatus 28 and a threaded fastener 32 that are cooperable. The threaded fastener 32 is a conventional threaded device such a metallic bolt having a shank 36 that is threaded, and further having a head 40. The threaded fastener 32 may optionally include a lock washer 44 that is engageable by the head 40.

The connection apparatus 28 can be said to include a connector 48 and a connection element 52. In the depicted exemplary embodiment, the connector 48 is a conventional 3/0 aluminum lug that is modified as is set forth in greater detail elsewhere herein. The exemplary connection element 52 is a block of conductive material such as aluminum or copper, by way of example, that is formed to include a receptacle 56 that is threaded. The receptacle 56 is structured to threadably receive the shank 36 therein.

As mentioned above, the connector 48 is, in the depicted exemplary embodiment, a conventional 3/0 aluminum lug, but the connector 48 can be of other forms without departing from the present concept. The exemplary connector 48 can be said to include a support 60 upon which is disposed an engagement element 64 that is movable with respect to the support 60. As can be understood from FIGS. 1-5, the engagement element 64 has a hex-shaped socket formed in one end thereof to enable rotation with an appropriate tool. Since the engagement element 64 is threaded, its rotation enables it to be longitudinally advanced with respect to the support 60.

The support 60 can be said to include a base 68 to which are connected a pair of walls 72. The support 60 further includes a bridging element 76 that extends between the walls 72 and which is situated on the walls 72 opposite the base 68. The bridging element 76 has a bore 80 (FIGS. 4 and 5) formed therein which is threaded and which is threadably cooperable with the engagement element 64. It thus can be understood that rotation of the engagement element 64 in the bore 80 enables the engagement element 64 to be longitudinally advanced with respect to the support 60, as was mentioned above.

The support 60 also can be said to have an opening 84 formed therein. The base 68, the pair of walls 72, and the bridging element 76 are each situated adjacent the opening. The aforementioned longitudinal advancement of the engagement element 64 enables at least a portion of the engagement element 64 to be longitudinally receivable in the opening 84.

As is set forth elsewhere herein, the connector 48 is a conventional 3/0 aluminum lug, but it is modified slightly to enable its use as a component of the attachment apparatus 4. In particular, connector 48 is modified to have a cylindrical aperture 86 (FIGS. 4 and 5) formed therein, such as by drilling through the base 68, in order to receive the shank 36 therethrough. In the depicted exemplary embodiment, the aperture 86 is sized to provide no resistance to the shank 36 being received therethrough, but in other embodiments it may be desirable to provide other relationships of fitting between the aperture 86 and the shank 36.

As is generally understood, a conventional use of the connector 48 would be to receive a wire (such as a conventional 3/0 wire in the depicted exemplary embodiment, not depicted herein) in the opening 84, to further receive the end of a conductor of a circuit interrupter in its opening 84 and against the base 68, and for the engagement element 64 to be threaded through the bore 80 until the engagement element compressively engaged the wire and the conductor against the base 68 and in electric engagement with one another. However, the connector 48 is used differently in the disclosed and claimed concept.

Specifically, in the attachment apparatus 4 of the disclosed and claimed concept, the connection element 52 is receivable in the opening 84, along with the end of the conductor 16 in which the hole 24 is formed. The shank 36 is received through the hole in the lock washer 44 (if used) and is received through the hole in the ring terminal 12. The shank 36 is further received through the aperture 86 and the hole 24 and is threadably received in the receptacle 56. The threaded fastener 32 is threadably tightened in the receptacle 56 to cause the head 40 to compressively engage the lock washer 44 and the ring terminal 12 against an exterior surface of the base 68 of the support 60 and to compressively engage the compression element 52 and the conductor 16 with an internal, i.e., opposite, surface of the base 68. The tightened reception of the threaded fastener in the receptacle 56 as indicated above thus causes the connection element 52, the conductor 16, the support 60, the conductive element 6, the lock washer 44, and the threaded fastener 32 to be electrically connected together.

The engagement element 64 can be threaded with respect to the support 60 to compressively engage the connection element 52 to retain the connection element 52 in place with respect to the support 60. This is advantageous since it enables the threaded fastener 32 to be unthreaded and removed from the connection element 52, such as to electrically disconnect the conductive element 6 from the conductor 16, without movement of the connection element 52. Such removal is depicted generally in FIG. 5. The threaded fastener 32 can then simply be again threadably received in the receptacle 56, with or without the addition of the conductive element 6 with its ring terminal 12.

Advantageously, therefore, the attachment apparatus 4 serves as a terminal that enables the conductive element 6 with its ring terminal 12 to be reliably electrically connected with the conductor 16. The engagement of the engagement element 64 against the connection element 52 retains the connection element 52 in a given position with respect to the support 60 and enables the threaded fastener 32 to be easily removed and returned to the receptacle 56 with minimal effort since the connection element 52 with which the threaded fastener 32 is threaded is retained in a given position with respect to the support 60.

In the depicted exemplary embodiment, the pair of walls 72 include a pair of ledges 88 that protrude generally into the opening 84 and which are engageable with the connection element 52 to resist rotation of the connection element 52 during threading of the threaded fastener 32 or during threading of the engagement element 64 in the bore 80, or both. In this regard, it is noted that the typical installation methodology would be to first receive the connection element 52 and the conductor 16 in the opening 84, and to threadably receive the shank 36 through the holes in the lock washer 44 and the ring terminal 12, through the aperture 86, and through the hole 24 in the conductor 16. The shank 36 would then be threadably received in the receptacle 56 until sufficiently tightened therein. The connection element 52 would then typically be threaded in the bore 80 until it compressively is engaged with the connection element 52. It is noted, however, that other installation methodologies can be employed, and the components can be assembled in other orders without departing from the present concept.

By providing both the connection element 52 and the engagement element 64, the ring terminal 12 can be reliably electrically connected with the conductor 16, can be removed therefrom, and can be again connected, all without the need to constantly reposition and adjust the connection element 52. Rather, the connection element 52 can be installed once, i.e., the first time the connection element 52 is installed in the opening 84, and can thereafter be advantageously retained in position by engagement of the engagement element 64 therewith, which saves time and effort in making and changing electrical connections with the circuit interrupter 20.

As is depicted in greater detail in FIG. 5, the circuit interrupter 20 additionally includes a line conductor 92 that is electrically connected with a source of electrical power, and further includes a set of separable contacts 96 that are electrically situated between the line conductor 92 and the conductor 16 which, as set forth elsewhere herein, is described as being an exemplary load conductor. As is understood in the general art, the set of separable contacts 96 are separable to electrically isolate the line and load conductors 92 and 16 depending upon certain predefined circumstances. The advantageous provision of the improved attachment apparatus 4 advantageously saves time and effort by serving as a terminal that enables a ring terminal 12 to be reliably connected with the circuit interrupter 20, which is highly desirable.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit interrupter comprising:

a set of separable contacts;

a conductor that is electrically connected with at least a portion of the set of separable contacts, the conductor having a hole formed therein and being one of a line conductor and a load conductor;

a connection apparatus comprising an electrically conductive connection element and an electrically conductive connector;

the connection element being in the form of a block of conductive material having a threaded receptacle formed therein;

the connector comprising a support and an engagement element;

the support comprising a base having an aperture formed therein, the support further having a threaded bore formed therein, the engagement element being threadably cooperable with the threaded bore; and an electrically conductive threaded fastener that is threadably cooperable with the receptacle, the fastener having a head and a shank, the shank being receivable through the aperture formed in the base, receivable through the hole formed in the conductor, and threadably receivable in the receptacle, the head and the connection element being structured to retain at least a portion of the conductor and at least a portion of the base situated therebetween and electrically connected therewith when the shank is threadably received in the receptacle.

2. The circuit interrupter of claim 1 wherein the shank is structured to be received through a ring terminal of the conductive element, the head and the connection element being structured to retain the ring terminal compressively situated between the head and the base and electrically connected therewith when the shank is threadably received in the receptacle.

3. The circuit interrupter of claim 1 wherein the engagement element is structured to compressively retain the connection element and the at least portion of the conductor between the engagement element and the at least portion of the base and electrically connected therewith when the engagement element is compressively engaged with the connection element.

4. The circuit interrupter of claim 3 wherein the support further has at least a first wall that extends from the base and is structured to be engageable with the connection element to resist rotation of the connection element during threading of the fastener in the receptacle.

5. The circuit interrupter of claim 4 wherein the support has opening formed therein that is situated adjacent the base and the at least first wall, and wherein the connection element is situated in the opening when the shank is received in the receptacle.

6. The circuit interrupter of claim 5 wherein the support further comprises a second wall situated opposite the first wall, the opening being additionally situated adjacent the second wall.

7. The circuit interrupter of claim 6 wherein the first and second walls each include a protruding ledge that is engageable with the connection element to resist rotation of the connection element during threading of the fastener in the receptacle.

8. The circuit interrupter of claim 5 wherein the connection element is sized to be at least partially received in the opening.

9. The circuit interrupter of claim 3 wherein the threaded bore is situated opposite the aperture, the threaded bore being structured to threadably receive the engagement element therein.

10. The circuit interrupter of claim 3 wherein the fastener is removable from the receptacle and replaceable therein when the connection element and the at least portion of the conductor are compressively retained between the engagement element and the at least portion of the base and electrically connected therewith.

11. The circuit interrupter of claim 1 wherein the at least portion of the conductor is interposed between the connection element and the at least portion of the base when the shank is threadably received in the receptacle.

12. The circuit interrupter of claim 1 wherein the at least portion of the conductor is interposed between the connection element and the at least portion of the base when the engagement element is threadably received in the threaded bore and is compressively engaged with the connection element.

* * * * *